US007269961B2

(12) United States Patent
Pendray

(10) Patent No.: US 7,269,961 B2
(45) Date of Patent: Sep. 18, 2007

(54) THERMODYNAMIC CYCLE APPARATUS AND METHOD

(76) Inventor: John R. Pendray, 224 Albany St., Apt. 382, Cambridge, MA (US) 02139

( * ) Notice: Subject to any disclaimer, the term of this patent is extended or adjusted under 35 U.S.C. 154(b) by 223 days.

(21) Appl. No.: 11/221,209

(22) Filed: Sep. 7, 2005

(65) Prior Publication Data

US 2007/0017247 A1 Jan. 25, 2007

Related U.S. Application Data

(60) Provisional application No. 60/701,830, filed on Jul. 22, 2005.

(51) Int. Cl.
*C09K 5/04* (2006.01)
*F25B 1/00* (2006.01)

(52) U.S. Cl. ..... 62/114; 62/501

(58) Field of Classification Search ..... 62/6, 62/82, 114, 238.1, 46, 501, 513; 417/207, 417/395; 60/519–521
See application file for complete search history.

(56) References Cited

U.S. PATENT DOCUMENTS 3,036,526 A * 5/1962 Hise ..... 417/389
3,708,996 A * 1/1973 Wurm ..... 62/116
3,763,663 A * 10/1973 Schlichtig ..... 62/498
3,767,325 A * 10/1973 Schuman ..... 417/207
4,072,010 A * 2/1978 Schuman ..... 60/520
4,132,505 A * 1/1979 Schuman ..... 417/207
4,215,548 A * 8/1980 Beremand ..... 60/520
4,418,547 A * 12/1983 Clark, Jr. ..... 62/116

(Continued)

FOREIGN PATENT DOCUMENTS

EP 0101565 A1 * 2/1984
JP 60-43158 A * 3/1985

OTHER PUBLICATIONS

Moran, M. J., Shapiro, H. N.; *Fundamentals of Engineering Thermodynamics,* 3rd ed.; John Wiley & Sons, Inc., 1995; pp. 178-183.

(Continued)

*Primary Examiner*—Mohammad M. Ali
(74) *Attorney, Agent, or Firm*—Altera Law Group, LLC

(57) ABSTRACT

A compressor and heat pump combination has an active chamber and a passive chamber, each with its own hot plate and cold plate. The two chambers are joined along an edge by a membrane that largely transmits pressure, largely insulates against temperature transfer, and prevents passage of gases from one chamber to the other. The gas in the active chamber is alternately cooled and heated by exposure to the active cold and active hot plates, causing pressure changes in the active chamber that are transmitted to the passive chamber by the membrane. The pressure changes alternately cool the gas in the passive chamber below the temperature of the passive cold plate, and heat the gas in the passive chamber above the temperature of the passive hot plate. In alternately exposing the cooled gas in the passive chamber to the passive cold plate, and the heated gas in the passive chamber to the passive hot plate, heat is forced to flow from the passive cold plate to the passive hot plate. Other thermodynamic apparatus including stand alone compressors and heat pumps are described.

28 Claims, 9 Drawing Sheets

U.S. PATENT DOCUMENTS 4,566,291 A 1/1986 Halavais
4,802,332 A 2/1989 Beale
5,088,284 A * 2/1992 Momose ..... 60/517
5,317,874 A * 6/1994 Penswick et al. ..... 60/517
5,638,684 A * 6/1997 Siegel et al. ..... 62/6
5,645,407 A 7/1997 Kralick et al.
6,302,660 B1 * 10/2001 Kurita et al. ..... 417/383

OTHER PUBLICATIONS

U.S. Appl. No. 60/701,830 for John R. Pendray entitled "Heat Pump", filed Jul. 22, 2005.

* cited by examiner

THERMODYNAMIC CYCLE APPARATUS AND METHOD

CROSS-REFERENCE TO RELATED APPLICATIONS

This application claims the benefit of U.S. Provisional Patent Application No. 60/701,830, filed Jul. 22, 2005, which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to thermodynamic cycle apparatus and methods, and more particularly to thermodynamic cycle apparatus including compressors and heat pumps and related methods.

2. Description of the Related Art

One type of engine is commonly known as a Stirling engine. The Stirling engine has a fixed mass of a gas inside its chamber, which remains in the chamber during operation of the engine.

At various points in the cycle of the Stirling engine, the fixed mass of gas is alternately heated and cooled, thereby changing its pressure. The pressure increases when the gas is heated, and the pressure decreases when the gas is cooled. The chamber of the engine is contiguous with a piston chamber, so that an increase in pressure drives the piston outward, and a decrease in pressure drives the piston inward. The moving portion of the piston is mechanically linked to a rotating shaft, which in turn drives a generator and produces electrical power; other uses and applications are also possible.

The heating and cooling functions are typically performed by a pair of hot and cold plates, located on opposite sides of the chamber. A displacer that can easily move back and forth inside the chamber forces the gas into contact with one plate while insulating it from the other. Air flows around the perimeter of the displacer, and movement of the displacer from one side to the other requires very little energy.

The hot plate is heated by a generally continuous source of heat, such as a flame, or a solar panel. The cold plate can be at room temperature, or cooled in a continuous manner, such as evaporatively or being located in or near a bath of ice.

An example of a Stirling engine is shown in FIGS. 13 and 14. The hot plate 136 and cold plate 137 are on opposite sides of a chamber 135. The sides adjacent to the hot and cold plates are thermally insulated, so that the heat flowing in and out of the chamber through the sides is minimized. The chamber 135 is filled with a fixed mass of fluid, which may be a gas such as air. A displacer 134 moves within the chamber 135, and forces the gas inside the chamber 135 into thermal contact with one of the plates, while insulating it from the other plate. Air flows around the displacer 134, which requires very little energy to move from one side to the other of the chamber 135.

FIG. 13 shows the Stirling engine in a "hot" position 130, with the displacer 134 held against the cold plate 137 by the displacer actuator 133, so that the gas in the chamber 135 is in thermal contact with the hot plate 136 and is insulated from the cold plate 137. Because there is a fixed amount of gas in the chamber, when the gas absorbs heat from the hot plate 136, it expands through the chamber outlet 138 and drives the piston 139 outward. As a result, the piston actuator 141 drives a crankshaft 132. The crankshaft 132, pivotably attached to the frame 142 by one or more bearings 143, rotates under the influence of the piston actuator 141, and turns generator 131. The generator 131 produces electricity, for use external to the engine 130. The engine 130 may have an optional flywheel 144 for stability.

Note that it takes very little energy to move the displacer 134 inside the chamber 135, so that the displacer actuator 133 can easily be driven by the rotating crankshaft 132 with very little loss. The displacer 134 itself is a lightweight thermal insulator, and it moves relatively freely inside the chamber of the Stirling engine 130. Its primary purpose is not to compress the gas in the chamber 135, but to force the gas into contact with one of the plates while insulating the gas from the other plate. There is room around the perimeter of the displacer 134 for gas to flow, so it requires very little energy to move the displacer 134 from one orientation to the other.

FIG. 14 shows the Stirling engine in the "cold" position 140, where the crankshaft has rotated 180 degrees from the view shown in FIG. 13. The displacer actuator 133 has moved the displacer 134 into contact with the hot plate 136, so that the gas is in thermal contact with the cold plate 137. The cold plate 137 absorbs some heat from the gas, so that the gas cools and, therefore, contracts. The reduction of pressure inside the chamber drives the piston 139 inward, causing the piston actuator 141 to further rotate the crankshaft 132.

For each rotation of the crankshaft 132, the engine passes continuously from the "hot" state to the "cold" state and back again.

Note that the piston actuator 141 and the displacer actuator 133 typically are out-of-phase, with a value between 0 degrees and 180 degrees.

Conversion of the Stirling engine of FIGS. 13 and 14 to a heat pump is straightforward, requiring replacement of the generator 131 with a motor, and optionally requiring adjustment of the phase between the piston actuator 141 and the displacer actuator 133, so that they are essentially opposite that as drawn in FIGS. 13 and 14. When used as a heat pump, the motor turns the crankshaft 132, driving the piston actuator 141 and, in turn, the piston 139. For heat pump operation, the chamber is forcibly expanded when the gas is in contact with the cold plate, and the chamber is forcibly compressed when the gas is in contact with the hot plate.

For one part of the heat pump cycle, the piston 139 is driven outward by the piston actuator, decreasing the pressure of the fixed amount of gas inside the chamber 135. The gas is therefore cooled, and is cooled below the temperature of the cold plate 137. The gas is then brought into thermal contact with the cold plate 137, and heat flows from the cold plate 137 into the gas, making the cold plate 137 even colder.

In the next part of the heat pump cycle, the piston is driven inward by the piston actuator 141, increasing the pressure and, therefore, the temperature of the gas. The temperature of the heated gas is greater than that of the hot plate 136. The gas is then brought into thermal contact with the hot plate 136, and heat flows from the gas into the hot plate 136, making the hot plate 136 even hotter.

These two parts of the cycle then repeat, thereby converting a mechanical energy supplied by the motor to a transfer of heat from a cold body to a hot body.

The Stirling engine has many advantages over other types of engines. For instance, there is a fixed amount of gas sealed inside the Stirling engine, which never leaves the engine. The heat source may be continuous, so that the amount of exhaust fumes is much less than for comparable internal or external combustion engines. Because the gas is sealed inside the chamber, environmentally risky materials may be used without risk of contaminating the surroundings. Also, a Stirling engine uses an external heat source, which could be a continuously-burning flame, solar energy, or a variety of others. Unlike an internal combustion engine, no explosions take place, so operation of a Stirling engine is typically very quiet.

There are drawbacks, though, to existing engines and heat pumps based on the Stirling engine of FIGS. 13 and 14. For instance, the gas-filled chamber is coupled to a mechanical piston. Mechanical pistons are inherently inefficient, in that they have some amount of frictional losses. In a piston, one solid object moves against another solid object while maintaining a seal between them, and motion of one solid against another invariably has a frictional loss associated with it.

Accordingly, there exists a need for engines and heat pumps, and generally for thermodynamic cycle apparatus, that overcome the inherent losses caused by friction.

BRIEF SUMMARY OF THE INVENTION

A thermodynamic cycle apparatus is provided, comprising a first chamber for housing a first fluid within a variable volume; a hot plate; a cold plate; a thermal insulator for cyclically and alternately coupling the hot plate and the cold plate to the first chamber; a second chamber for housing a second fluid within a variable volume; and a deformable volume transmitting medium disposed between the first and second chambers for inversely varying the volume of one of the first and second chambers as a function of pressure in the other of the first and second chambers, the deformable volume transmitting medium having low thermal conductivity and being highly impermeable to the first and second fluids.

A further embodiment of a compressor is provided, comprising a first variable volume chamber comprising a first fluid; a second variable volume chamber comprising a second fluid; means for exposing the first fluid to a hot source while insulating the first fluid from a cold source to increase pressure of the first fluid and volume of the first chamber; means for deforming a portion of the second chamber to transfer the volume increase of the first chamber as a volume decrease in the second chamber and to substantially equalize pressures of the first and second fluids in the first and second chambers at a higher pressure; means for exposing the first fluid to a cold source while insulating the first fluid from a hot source to decrease pressure of the first fluid and volume of the first chamber; means for deforming the second chamber portion to transfer the volume decrease of the first chamber as a volume increase in the second chamber and to substantially equalize pressures of the first and second fluids in the first and second chambers at a lower pressure; and means for thermally insulating the first chamber from the second chamber.

A method of compressing fluid is provided, comprising exposing a first fluid within a first chamber to a hot source while insulating the first fluid from a cold source to increase pressure of the first fluid and volume of the first chamber; deforming a portion of a second chamber to transfer the volume increase of the first chamber as a volume decrease in the second chamber and to substantially equalize pressures of the first fluid in the first chamber and a second fluid in the second chamber at a higher pressure; exposing the first fluid to the cold source while insulating the first fluid from the hot source to decrease pressure of the first fluid and volume of the first chamber; deforming the second chamber portion to transfer the volume decrease of the first chamber as a volume increase in the second chamber and to substantially equalize pressures of the first and second fluids in the first and second chambers at a lower pressure; and thermally insulating the first chamber from the second chamber during all of the exposing and deforming steps.

A further embodiment of a compressor is provided, comprising a first chamber having a first fluid therein; a hot source having variable thermal conductivity with the first chamber; a cold source having variable thermal conductivity with the first chamber; a second chamber having a second fluid therein; and a deformable transfer medium disposed between the first and second chambers and in contact with the first and second fluids, the deformable transfer medium having low thermal conductivity and being highly impermeable to the first and second fluids.

A compressor and heat pump combination is provided, comprising a compressor chamber having a compressor fluid therein; a compressor hot plate; a compressor cold plate; a compressor thermal insulator for cyclically and alternately coupling the compressor hot plate and the compressor cold plate to the compressor chamber; a heat pump chamber having a heat pump fluid therein; a heat pump hot plate; a heat pump cold plate; a heat pump thermal insulator for cyclically and alternately coupling the heat pump hot plate and the heat pump cold plate to the heat pump chamber; and a deformable volume transmitting medium for inversely varying volumes of the compressor chamber and the heat pump chamber, the deformable volume transmitting medium having low thermal conductivity and being highly impermeable to the compressor fluid and the heat pump fluid, the compressor chamber being at least partially bounded by a first side of the deformable volume transmitting medium, and the heat pump chamber being at least partially bounded by a second side of the deformable volume transmitting medium.

A further embodiment of a compressor and heat pump is provided, comprisinga compressor chamber for housing a compressor fluid; a compressor hot element; a compressor cold element; means for cyclically and alternately coupling the compressor hot element and the compressor cold element to the compressor chamber; a heat pump chamber for housing a heat pump fluid; a heat pump hot element; a heat pump cold element; means for cyclically and alternately coupling the heat pump hot element and the heat pump cold element to the heat pump chamber; and means for transferring a volume between the compressor chamber and the heat pump chamber, the volume transfer means having low thermal conductivity and being highly impermeable to the compressor fluid and the heat pump fluid, the compressor chamber being at least partially bounded by a first side of the volume transfer means, and the heat pump chamber being at least partially bounded by a second side of the volume transfer means.

DETAILED DESCRIPTION OF THE INVENTION

In a thermodynamic cycle apparatus such as a compressor, a heat pump, or a compressor and heat pump combination, a deformable member is used to establish two variable volume chambers in which the respective volumes vary inversely as a function of changing pressure in one of the chambers. Suitable deformable members include liquids, non-mixing gases, flexible solids such as membranes, non-mixing plasmas, and other suitable materials. The primary function for the deformable member is transmitting a volume by equalizing pressure by deforming, without substantially transmitting heat. Advantageously, the use of a deformable member avoids the frictional loss and mechanical wear associated with solid parts that rub against each other, as in a mechanical piston.

Figure 1:
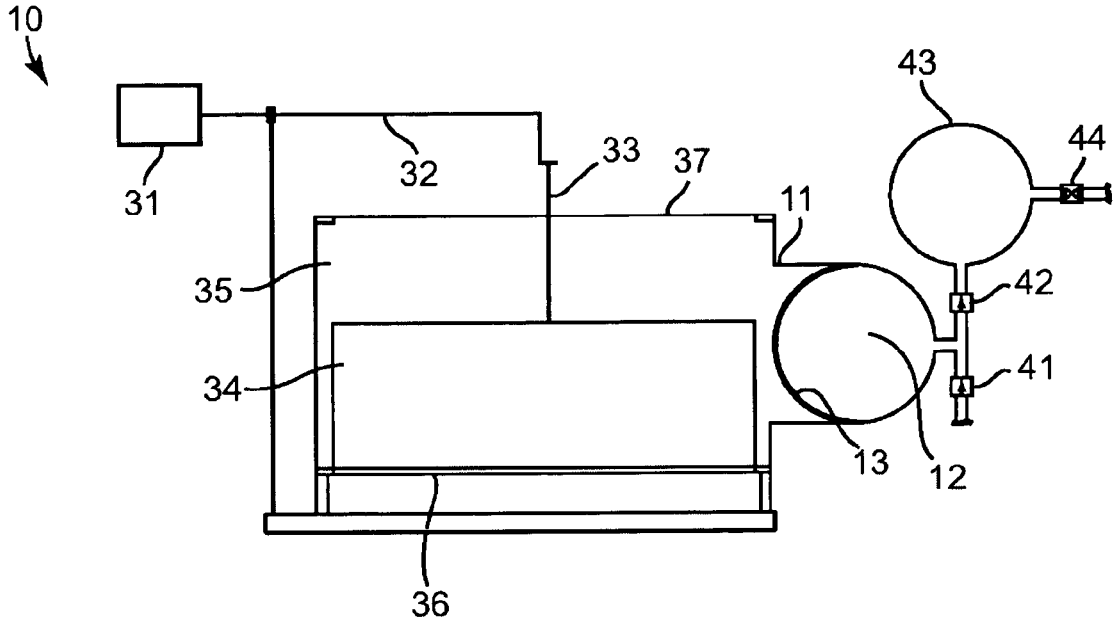
FIG. 1 is a plan drawing of a compressor, in the "cold" portion of its cycle.
Figure 2:
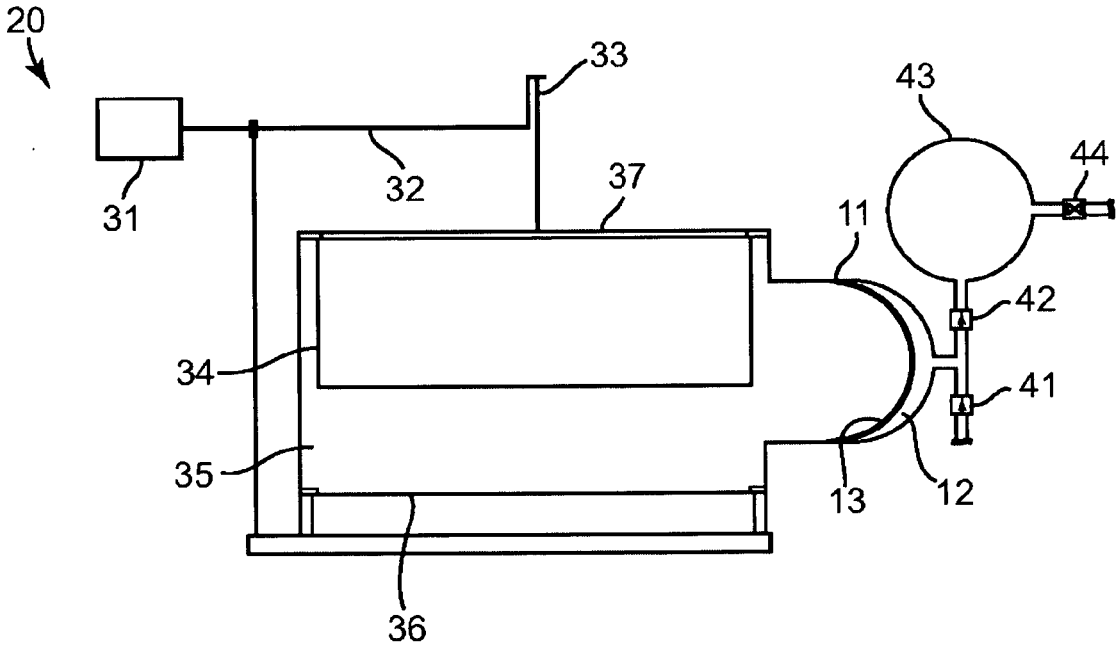
FIG. 2 is a plan drawing of the compressor of FIG. 1, in the "hot" portion of its cycle.

Elements of a thermodynamic cycle apparatus may be used to form a compressor. As shown in FIGS. 1 and 2, motor 31 pivots a crankshaft 32 about its longitudinal axis. A displacer 34 is connected by a displacer actuator 33 to the crankshaft 32, so that the displacer 34 translates cyclically inside a chamber 35 between a hot plate 36 and a cold plate 37. When the displacer 34 is in contact with the hot plate 36, it exposes the gas in the chamber 35 to the cold plate 37, thereby cooling the gas, and thermally insulates the gas in the chamber 35 from the hot plate 36. This cold position 10 is shown in FIG. 1. Similarly, FIG. 2 shows the compressor in a hot position 20, when the displacer 34 is in contact with the cold plate 37; the gas is exposed to the hot plate 36 and is thereby heated, and the gas is thermally insulated from the cold plate 37. The displacer 34 is preferably lightweight, is a good thermal insulator, and has a low specific heat. For instance, the displacer may be made of a foam material, although any suitable material may be used. The gas in the chamber 35 can freely flow around the perimeter of the displacer 34, and it requires very little power from the motor 31 to move the displacer.

The chamber 35 itself is preferably bounded on its edges by thermal insulation, so that the heat entering and leaving through its edges is minimized. The chamber 35 is filled with a non-solid material, which is preferably a gas such as air. The chamber 35 is sealed, so that the gas initially in the chamber remains in the chamber during and after operation of the compressor. The chamber volume itself may change in response to changes in pressure, but the actual gas in the chamber remains in the chamber. For instance, if pure nitrogen is used in the chamber, then the nitrogen remains uncontaminated by other gases throughout the use of the compressor 10.

The chamber 35 is contiguous with a compressor chamber 11, so that when the gas expands or contracts, the compressor chamber 11 experiences a change in volume. A membrane 13 is attached to the wall of the compressor chamber 11 around its perimeter, so that it separates the gas inside the chamber from the gas outside the chamber in region 12. The membrane 13 is flexible, so that it flexes or deforms in response to differences in pressure on either side of the membrane 13. The membrane 13 should be relatively impermeable to the gas inside the chamber, so that the chamber can remain sealed throughout operation. Ideally, the membrane 13 should be impermeable enough so that the gas inside the chamber remains in the chamber on a long-term basis without escaping and without contamination from external gases. Additionally, the membrane 13 should be a relatively good thermal insulator, so that the gas inside the chamber 35, which has a variable temperature, does not lose or gain heat from the region 12 outside the chamber, which would reduce the efficiency of the compressor 10.

For the compressor, which is shown in FIG. 1 in the "cold" portion 10 of its cycle, the gas inside the chamber 35 contracts, and the membrane 13 is deformed inward with respect to the chamber 35. An inlet check valve 41 lets air (or some other appropriate gas) into the region 12 outside the chamber, so that the pressure in chambers 35 and 12 approximately equalize.

The compressor shown in FIG. 2 is in the "hot" portion 20 of its cycle, in which the gas inside the chamber 35 is expanded, and the membrane 13 is deformed outward with respect to the chamber 35. As a result, a portion of the gas that was in the region 12 outside the chamber is forced through an outlet check valve 42 into a storage tank 43.

By alternately drawing in gas through the inlet check valve 41 and forcing gas through the outlet check valve 42, the pressure in the storage tank 43 is increased. A valve 44 controls the release of the gas from the storage tank 43.

To change the volume of gas moved by each cycle, the properties of the gas in the chamber 35 and/or the region 12 outside the chamber that is acted upon may be altered at portions of the cycle. For instance, the gas might go through a phase change, such as from liquid to gas or from gas to liquid, and can thereby increase the potential displacement per cycle of the membrane or the pressure differential. More specifically, the use of such a phase change may allow the use of more combinations of pressure and volume, such as high pressure and low volume, or low pressure and high volume. This property may be adjustable with the use of a phase change material.

The membrane 13 is drawn in FIGS. 1 and 2 as a deformable solid object. Alternatively, there are other types of deformable members that may be used in place of the flexible membrane 13.

Figure 3:
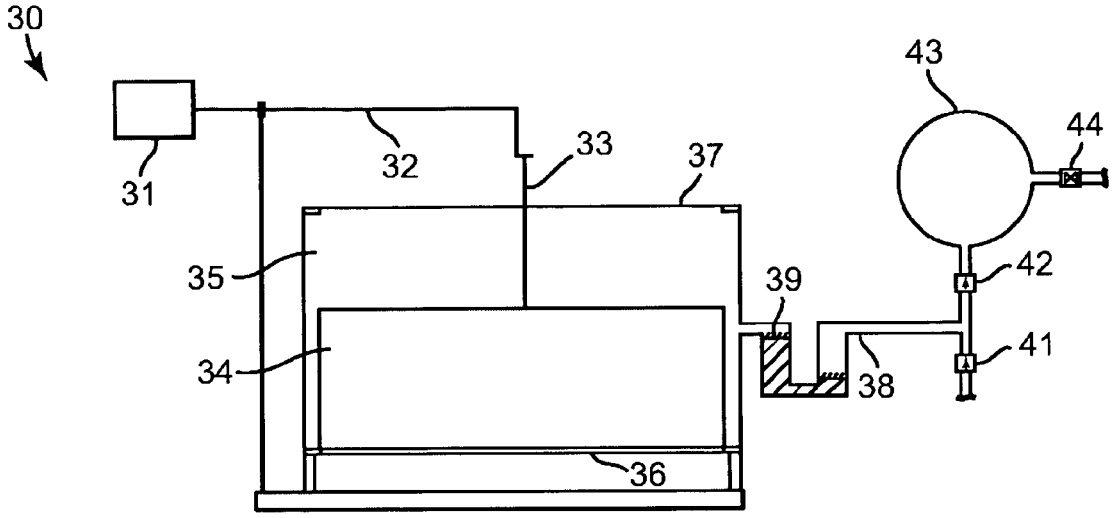
FIG. 3 is a plan drawing of a compressor, in the "cold" portion of its cycle.
Figure 4:
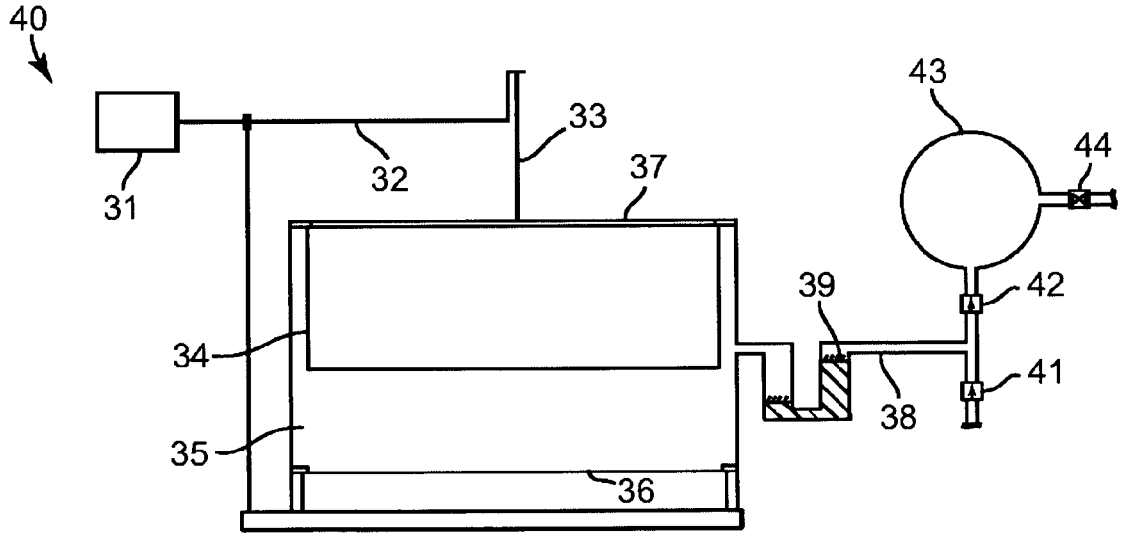
FIG. 4 is a plan drawing of the compressor of FIG. 3, in the "hot" portion of its cycle.

For instance, FIGS. 3 and 4 show a fluid 39 that substantially transmits the pressure from the chamber 35 to the portion 38 outside the chamber 35, while substantially thermally insulating the chamber 35 from the portion 38 outside the chamber 35. The fluid 39 may be a "non-mixing liquid", having a low thermal conductivity, a low specific heat, a low density, and a general inability to mix with the gas on either side of the fluid. An example of a non-mixing liquid is water, ammonia, or another suitable liquid. FIG. 3 shows a compressor in the "cold" portion 30 of its cycle. FIG. 4 shows a compressor in the "hot" portion 40 of its cycle.

Figure 8:
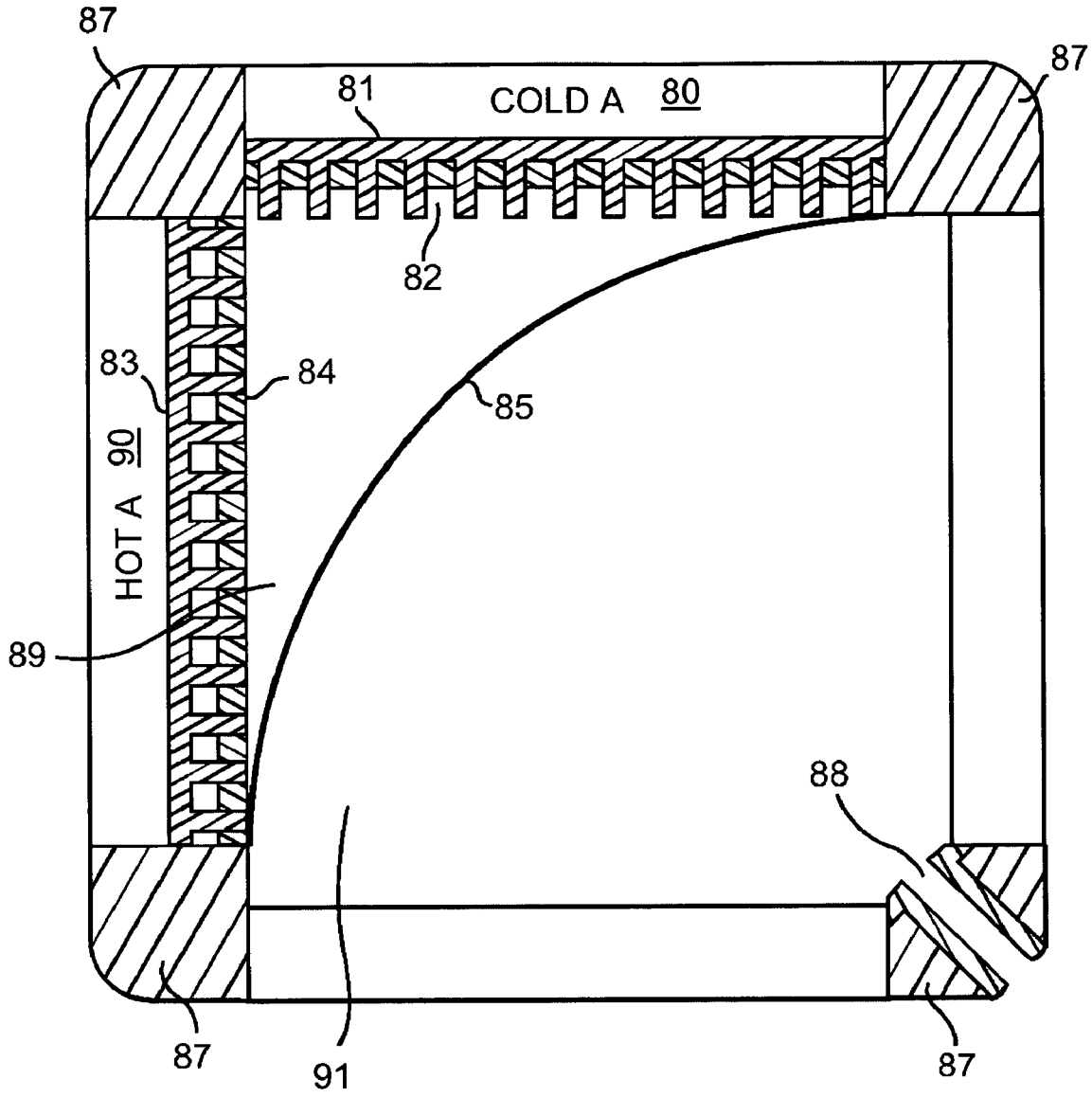
FIG. 8 is a plan drawing of a compressor, in the "cold" portion of its cycle.
Figure 9:
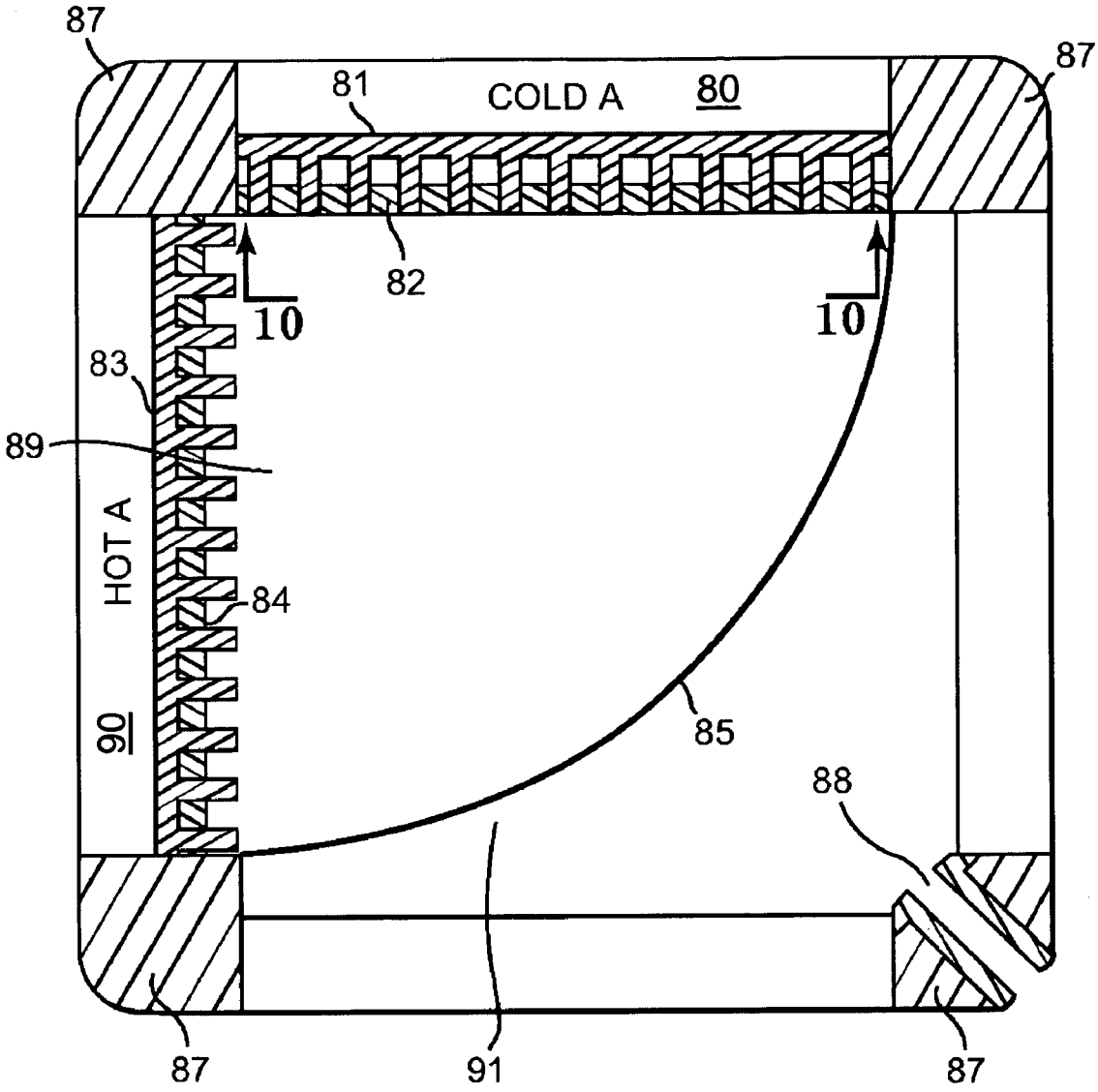
FIG. 9 is a plan drawing of the compressor of FIG. 8, in the "hot" portion of its cycle.

A further embodiment of a compressor is shown in FIGS. 8 and 9. This embodiment replaces many of the mechanical features with simplified parts, thereby reducing the complexity of the compressor, and potentially reducing its size and cost.

Although the mechanical layout is different from the embodiments of FIGS. 1-4, the physical principles of operation are the same. In a "hot" portion of the compressor cycle, a fixed amount of gas in a chamber is exposed to a hot plate and is insulated from a cold plate. The gas is heated, and therefore expands. The expansion of the gas increases the pressure on one side of a deformable member, which deforms in response to the pressure difference. As a result, the effective volume of the chamber increases, and the effective volume in the region outside the chamber on the opposite side of the deformable member decreases by the same amount. This decrease in volume increases the pressure outside the chamber, which is then coupled by an outlet valve to a storage tank, so that the amount of gas in the storage tank is increased. The pressure of the storage tank is therefore increased during the "hot" portion of the compressor cycle.

In a similar manner, the "cold" portion of the compressor cycle increases the volume and decreases the pressure outside the chamber opposite the deformable member. This decrease in pressure draws in more gas from an inlet valve, so that the amount of gas is increased between the inlet valve and the outlet valve during the "cold" portion of the compressor cycle.

By alternating between "hot" and "cold", gas is pumped from the inlet to the storage tank, which may be vented at will through a valve. Thus, a compressor is formed.

Whereas the embodiments of FIGS. 1-4 use a translating displacer to expose one plate and insulate the other, the embodiments of FIGS. 8 and 9 use plates with prongs that can protrude and retract through holes in an isolator for exposure and isolation, respectively. When the prongs protrude through the holes, a relatively large surface area of the plate is exposed to the gas in the chamber. When the prongs are within the holes, a much smaller surface area of the plate is exposed, and the plate is substantially insulated from the gas in the chamber. Either the plate or the insulator can move while the other remains fixed, or both can move.

In this manner, both the hot and cold plates have a variable thermal conductivity with respect to the gas in the chamber. For instance, if the plate prongs protrude through the insulator, the plate has a relatively high thermal conductivity with respect to the gas in the chamber. Likewise, if the plate prongs are within the insulator, the plate has a relatively low thermal conductivity with respect to the gas in the chamber.

Note that the embodiments of FIGS. 1-4 also have plates with variable thermal conductivity with respect to the gas in the chamber. If the displacer is moved in close proximity to a plate, then the plate becomes insulated from the chamber and therefore has a relatively low thermal conductivity with respect to the gas in the chamber. Likewise, if the displacer is moved away from a plate, then the plate becomes exposed to the chamber and therefore has a relatively high thermal conductivity with respect to the gas in the chamber.

In FIGS. 8 and 9, the compressor is laid out as a parallelepiped, with each face having a generally rectangular shape. The views of FIGS. 8 and 9 are cross-sections of the parallelepiped, cut in a plane parallel to the page.

As drawn, the cold plate 80, labelled as "Cold A", lies long the topmost edge of the compressor. The cold plate 80 has a cold plate heat sink 81, preferably having a high thermal conductivity and a high heat transfer to the gas in the chamber. The cold plate heat sink 81 is preferably made from a good heat conductor, such as copper, although other suitable materials may be used. The ends of the prongs on the cold plate heat sink 81 may preferably be capped with a thermal insulator (not shown), which more effectively insulates the cold plate from the chamber when the prongs are retracted. Although prongs are shown, many other heat transfer structures well-known in the art, such as, for example, fins, may be used as well.

The cold plate also has a cold plate insulator 82, which has holes that accommodate the prongs in the cold plate heat sink 81. The cold plate insulator 82 preferably has a low specific heat, has a low thermal conductivity, is lightweight, and produces a low amount of friction when contacting the prongs of the cold plate heat sink 81. Preferably, the cold plate insulator 82 aligns flush with the insulators that cap the prongs of the cold plate heat sink 81, so that when the prongs are retracted, the insulation between the cold plate and the gas in the chamber is maximized. The cold plate insulator 82 may be made from microporous silica, although other suitable materials may be used.

Note that the hot plate and cold plate shown in the various figures can have any number of configurations. The simplest may be a flat rectilinear body, as drawn in FIGS. 1-4. The hot plate can have a flame in thermal contact with the plate on the side opposite the chamber. The plates may have a low thermal mass, so that changes in the sources of heat and cold can quickly effect temperature changes in the chamber. Alternately, the plate can have a high thermal mass, so that the chamber temperature is relatively unaffected by rapid changes in the hot and cold sources. The plate may also have plumbing, such as water lines that can heat or cool the plate. Alternatively, the plates may have non-flat shapes, such as the heat sink shapes of FIGS. 8 and 9, or fins, prongs, pins, blocks, or any other suitable features that increase the effective surface area of the plate. The plate may also have several elements, such as a heat sink and an insulator, that may or may not move with respect to each other.

Preferably, the cold plate insulator 82 is moved by an actuator (not shown), and the cold plate heat sink 81 remains fixed with respect to the frame of the compressor. This is preferable because the insulator 82 may easily be designed with much less mass than the heat sink. An actuator (not shown) translates the insulator by a length roughly equal to the length of the heat sink prongs, suitable actuators being well known to one of ordinary skill in the art. Alternatively, the heat sink may move with the insulator remaining fixed, or both can move.

As drawn in FIGS. 8 and 9, the hot plate 90 is on the leftmost edge of the compressor, although any edge adjacent to the cold plate 80 may also be used. The hot plate 90 may be similar in construction to the cold plate, having a hot plate heat sink 83 and a hot plate insulator 84. The hot plate insulator 84 also is translatable by an actuator.

The actuators of the cold and hot plate insulators preferably move out of phase with respect to each other, in that when one plate is exposed, the other is insulated from the gas in the chamber. By alternately exposing one plate and then the other, the cycles of "hot" and "cold" are repeated.

FIG. 8 shows a compressor in the "cold" portion of the cycle. Note that the prongs of the cold plate heat sink 81 are exposed through the holes in the cold plate insulator 82. Note also that the prongs of the hot plate heat sink 83 are not exposed, and are generally flush with the hot plate heat sink 84. Because the prongs are preferably tipped with a thermal insulator, the hot plate 90 is well insulated from the gas in the chamber 89.

In the plane of the page, the chamber 89 is bounded by the cold plate, the hot plate, and a thermal insulator membrane 85. The edge faces of the compressor, parallel to the page and enclosing the entire compressor, are preferably good thermal insulators, which reduce the exchange of heat between the chamber and the exterior of the compressor.

The thermal insulator membrane 85 separates the interior of the compressor into an active chamber 89, and a passive chamber 91. The active chamber 89 expands and contracts in a manner similar to the chamber 35 of FIGS. 1-4, by deforming the thermal insulator membrane 85. The active chamber 85 is actually or effectively sealed, so that no gas enters or leaves the active chamber 89 during operation of the compressor.

In the plane of the page, the passive chamber 91 is bounded by the thermal insulator membrane 85 and the interior walls, which may be thermally insulating or conductive as desired. The passive chamber 91 is connected to the appropriate valves and a storage tank (not shown) by a fluid transfer pipe 88.

The frame of the compressor is held together structurally by a series of structural/thermal dividers 87, which preferably have a low thermal conductivity, a high strength, and a high toughness. The structural/thermal dividers 87 may be made from calcium silicate, although other suitable materials may be used.

The thermal insulator membrane 85 is held in place around its perimeter, being preferably attached to the structural thermal dividers 87 along two sides, and attached to the edge faces, parallel to the page, along the remaining two sides. The thermal insulator membrane 85 preferably has a low specific heat, has a low thermal conductivity, is lightweight, and is easily deformed, so that there is a minimal loss of energy during deformation. Ideally, the thermal insulator membrane 85 should transmit the pressure between the active chamber 89 and the passive chamber 91 without allowing any diffusion of the gases themselves from one chamber to the other, and should thermally insulate the active chamber 89 from the passive chamber 91. The thermal insulator membrane 85 may be made from a foil sealed mineral wool, although any suitable material may be used. For example, one example of a thermal insulator membrane 85 may be a laminated structure, with a sealing material such as mylar on the outside of the structure, and an insulating material such as fiberglass or foam on the inside of the structure. Other suitable materials and structure may be used.

FIG. 9 shows a compressor in the "hot" portion of the cycle. Note that the prongs of the hot plate heat sink 83 are exposed through the holes in the hot plate insulator 84. Note also that the prongs of the cold plate heat sink 81 are not exposed, and are generally flush with the cold plate heat sink 82. Because the prongs are preferably tipped with a thermal insulator, the cold plate is well insulated from the gas in the chamber.

Figure 10:
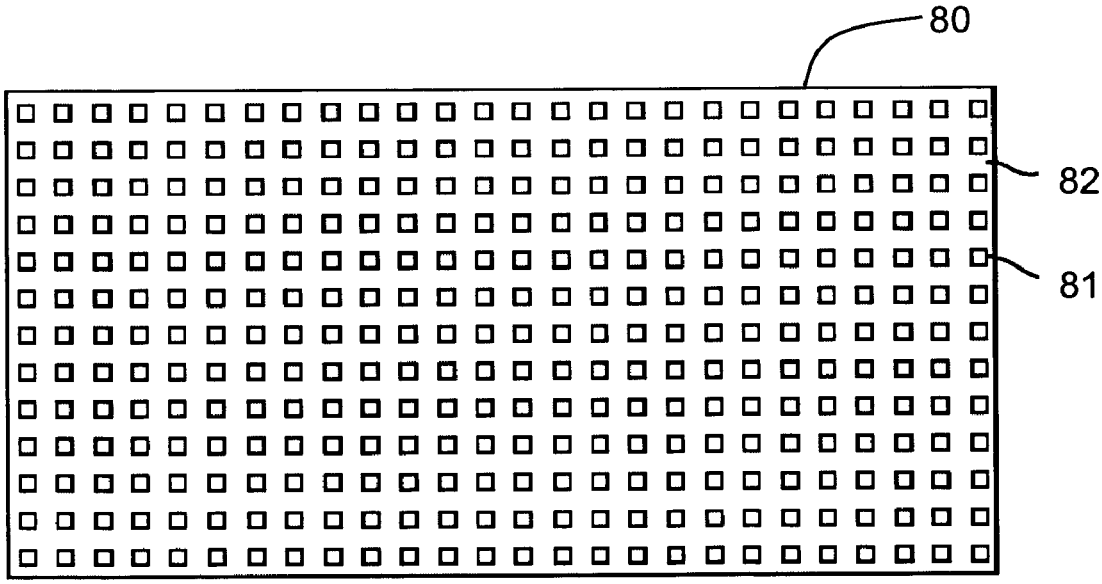
FIG. 10 is a plan drawing of a cold plate insulator and a cold plate heat sink.

FIG. 10 shows an end-on view of the cold plate 80 from FIGS. 8 and 9. Seen from the inside of the chamber, the cold plate appears as the cold plate insulator 82 with a series of holes. The prongs of the cold plate heat sink 81 extend into the inside of the chamber through the holes in the cold plate insulator 82. The hot plate 90 has a similar construction.

Much of the discussion thus far has been directed toward a compressor. Advantageously, much of the structures shown in the compressors of FIGS. 1-4 and 8-10 may be used to form a heat pump and/or a combination compressor and heat pump.

Figure 5:
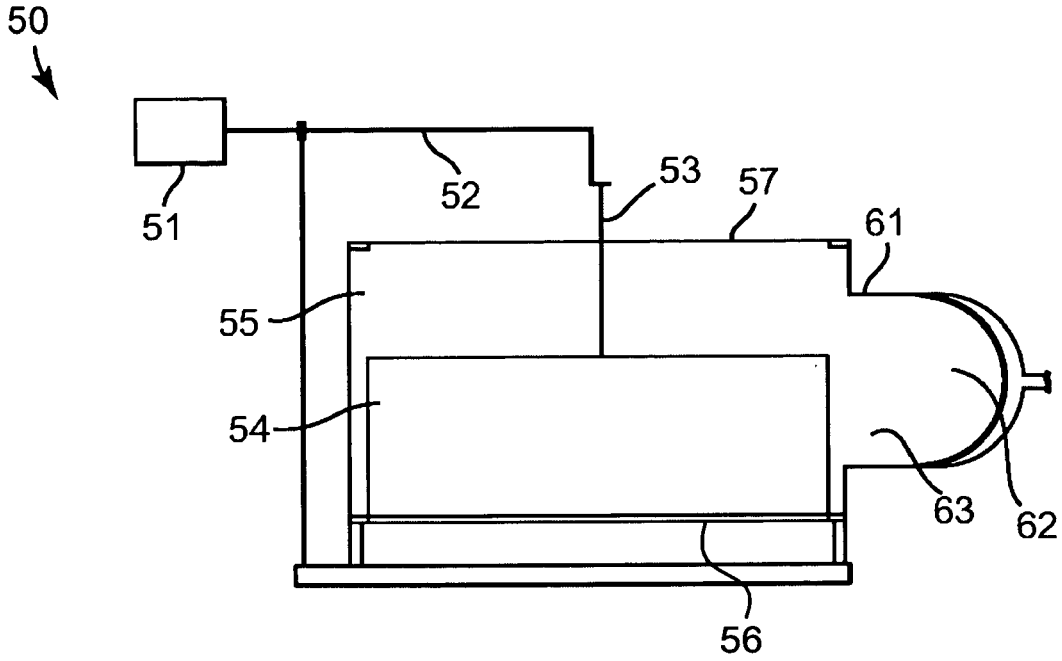
FIG. 5 is a plan drawing of a heat pump, in the "cold" portion of its cycle.

FIG. 5 shows a heat pump 50, based on the same physical structures as the compressor of FIGS. 1-4. A motor 51 turns a crankshaft 52, which translates a displacer 54 via displacer actuator 53. As with the compressor of FIGS. 1-4, the displacer 54 requires very little energy to move from one side of the chamber 55 to the other, and the power requirements of the motor 51 are small. In FIG. 5, the displacer 54 forces the gas in the chamber 55 into thermal contact with a cold plate 57 and insulates the gas from a hot plate 56. A compressor chamber 61 is contiguous with the chamber 55, with a membrane 63 separating the chamber 55 from the region 62 outside the chamber.

The heat pump 50 converts a varying pressure in the region 62 outside the chamber 55 to heat the hot plate 56 and cool the cold plate 57. FIG. 5 shows the heat pump in the "cold" part 50 of its cycle. The region 62 outside the chamber has a relatively low pressure, which expands the gas in the chamber 55 and thereby cools it, removing heat from the cold plate 57.

Figure 6:
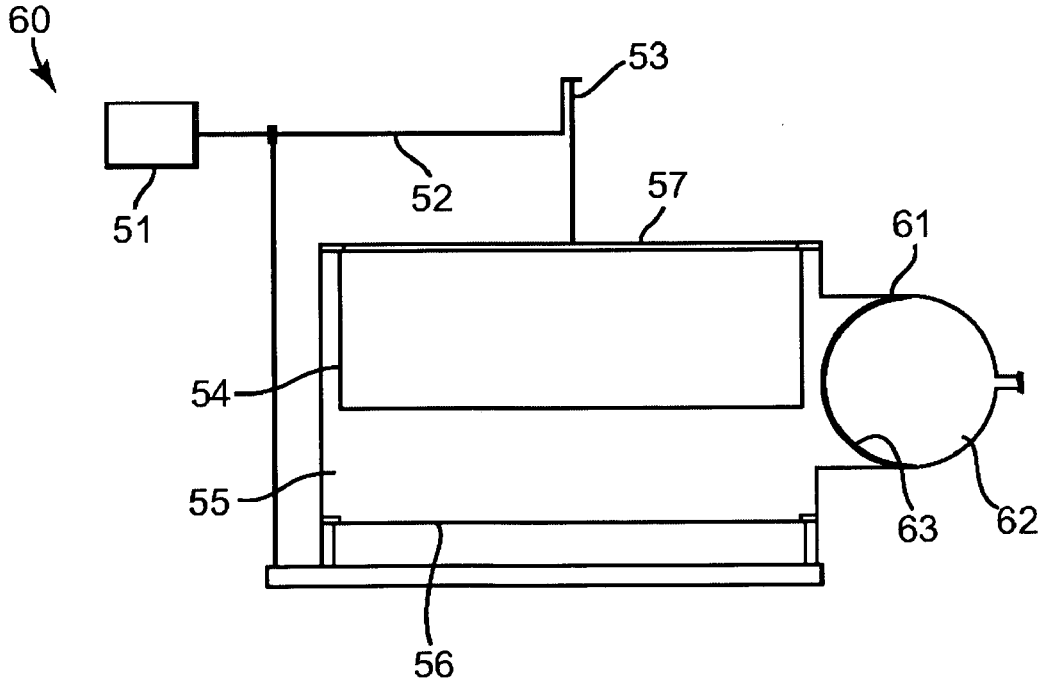
FIG. 6 is a plan drawing of the heat pump of FIG. 5, in the "hot" portion of its cycle.

Likewise, FIG. 6 shows the heat pump in the "hot" part 60 of its cycle, in which the gas in the chamber 55 is compressed into thermal contact with the hot plate 56 and is insulated from the cold plate 57. The heat pump 60 is driven by the relatively high pressure in the region 62 outside the chamber 35, which compresses the gas in the chamber 35 and thereby heats it, adding heat to the hot plate 36.

Note that compared to the compressor of FIGS. 1 and 2, the heat pump of FIGS. 5 and 6 has its high/low pressures and hot/cold temperatures out of phase.

In the same manner as described above, the compressor of FIGS. 8 and 9 may be converted into a heat pump by driving the passive chamber 91 with a varying pressure, and optionally adjusting the phase between the cycling of the plates and the high and low pressures. In this manner, the varying pressure transfers heat from the cold plate to the hot plate.

The functions of the compressor and the heat pump may be combined into a single device. Such a device may receive its input power from the heating of the active hot plate by, for example, burning a fuel such as natural gas, coal, or oil, although other suitable fuels such as nuclear energy or thermal sources such as hot springs may be used. The active chamber would then function as a compressor, with the passive chamber acting as a heat pump. The two chambers would then operate synchronously to establish a temperature differential between the passive cold plate and the passive hot plate in each cycle.

Figure 11:
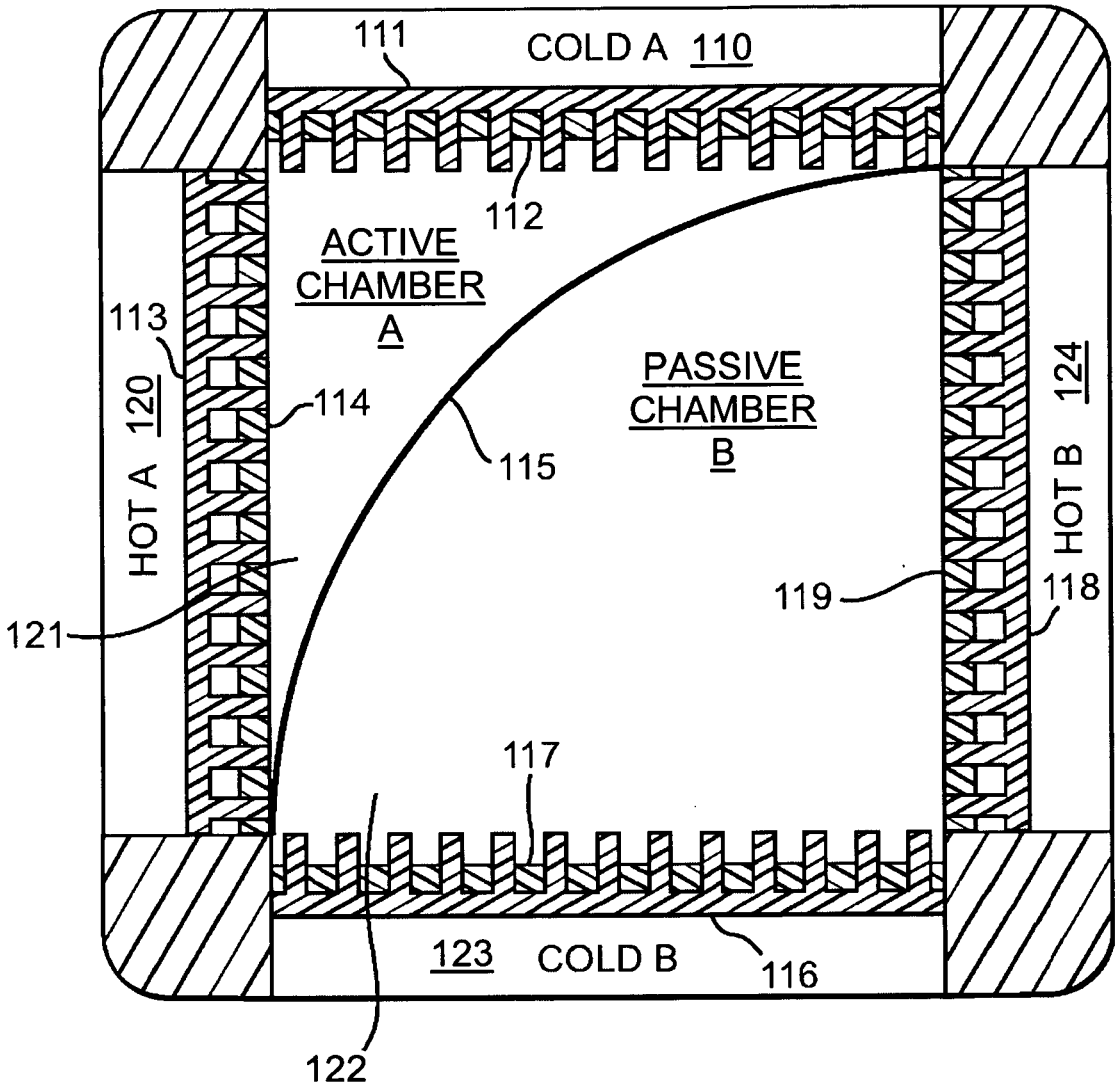
FIG. 11 is a plan drawing of a heat pump, in the "cold" portion of its cycle.
Figure 12:
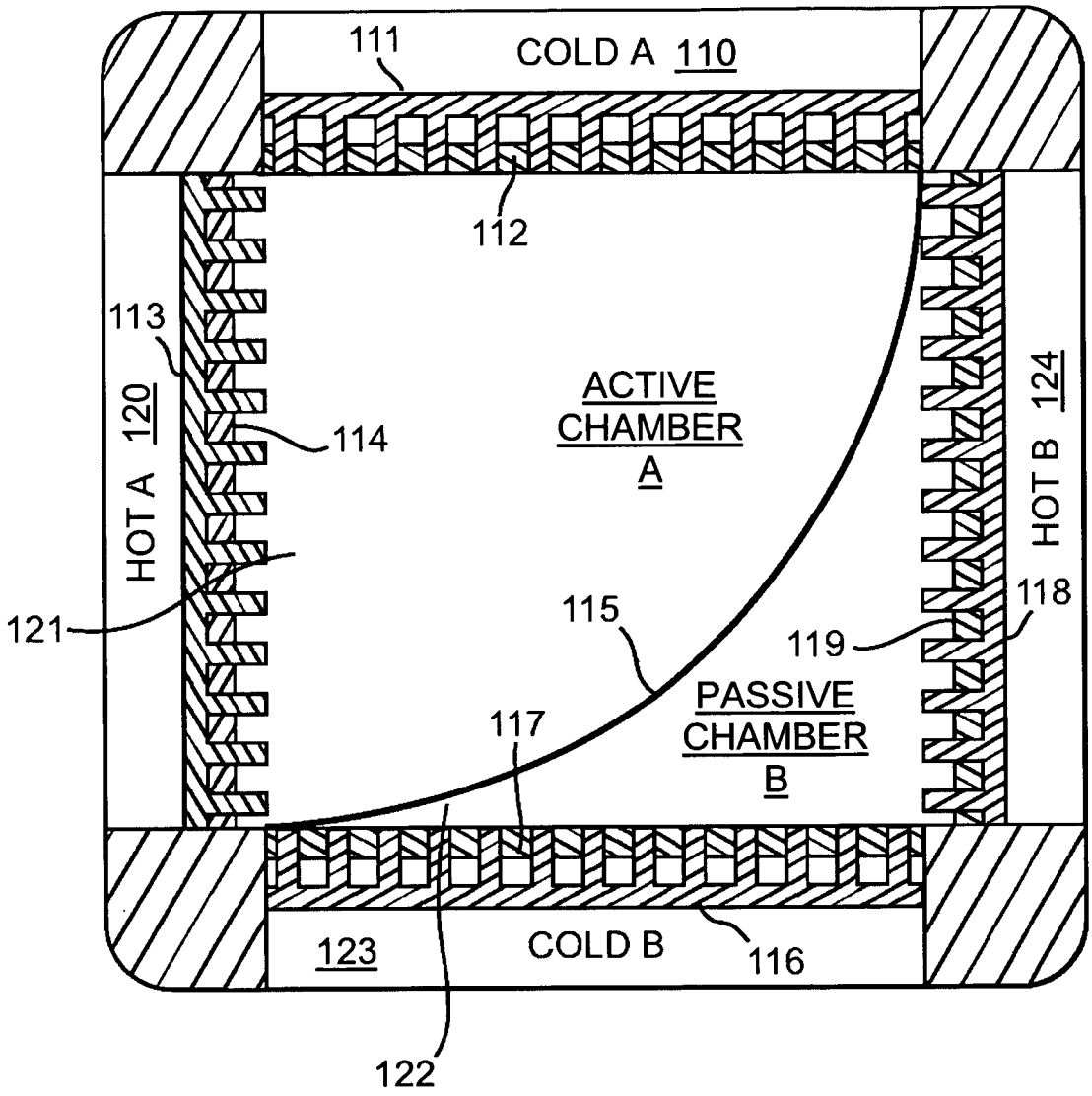
FIG. 12 is a plan drawing of the heat pump of FIG. 11, in the "hot" portion of its cycle.
Figure 13:
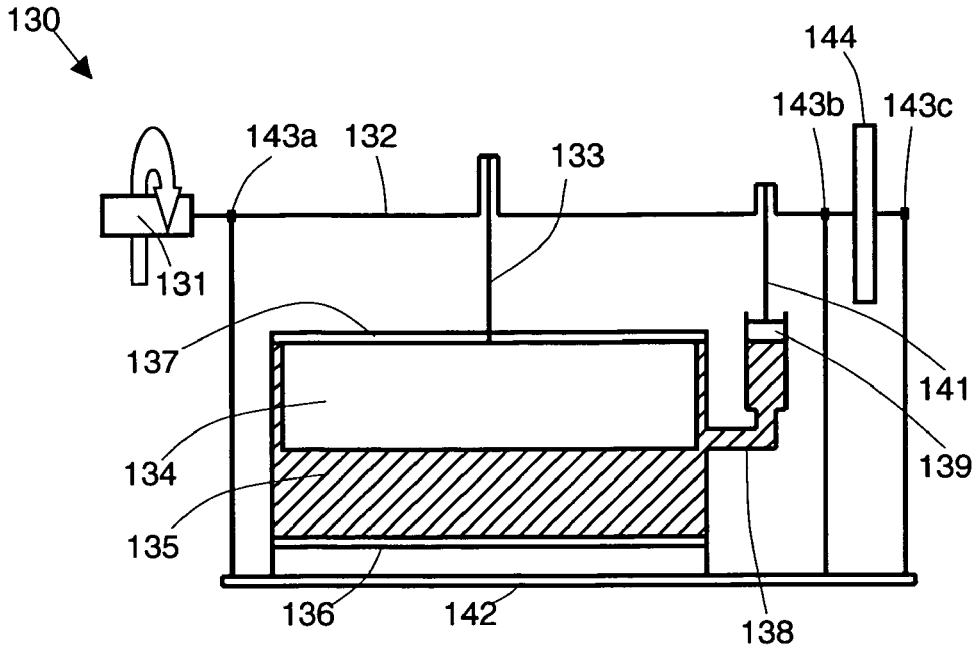
Fig. 13 PRIOR ART
FIG. 13 is a plan drawing of a known Stirling engine, in the "hot" portion of its cycle.
Figure 14:
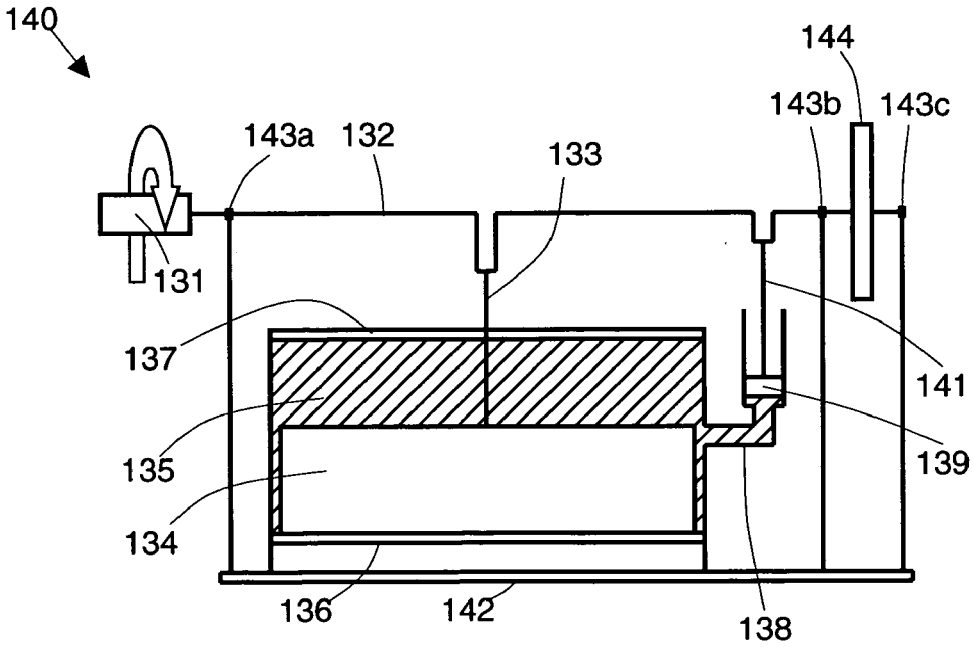
Fig. 14 PRIOR ART
FIG. 14 is a plan drawing of the known Stirling engine of FIG. 13, in the "cold" portion of its cycle.

FIGS. 11 and 12 show a combination compressor and heat pump, based mechanically on the support structure shown in FIGS. 8 and 9. The compressor and heat pump each has its own chamber, each with its own cold and hot plates, separated by a thermal insulator membrane that largely transmits volume changes but not temperature.

The chambers may be designated as "A" and "B", although no significance is attributed to these designations. It will be assumed during the following discussion that chamber A assumes an "active" role, and chamber B assumes a "passive" role, in that the temperature differences in chamber A are used to force heat to flow from the cold plate to the hot plate in chamber B. Chambers A and B may also be considered a compressor chamber and a heat pump chamber, respectively. In this terminology, the compressor chamber drives the heat pump chamber through pressure and/or volume changes that are coupled from one chamber to the other by a thermal insulator membrane.

As with the structures of FIGS. 8 and 9, the views of FIGS. 11 and 12 are cross-sections, and the edge faces that are parallel to the page are preferably thermal insulators, which inhibit the transfer of heat into or out of the heat pump.

Chamber A 121 is bounded by cold plate A 110, hot plate A 120, and a thermal insulator membrane 115. The cold plate A 110 has a cold plate A heat sink 111 and a cold plate A insulator 112. The hot plate A 120 has a hot plate A heat sink 113 and a hot plate A insulator 114. Chamber B 122 is bounded by cold plate B 123, hot plate B 124, and the same thermal insulator membrane 115. The cold plate B has a cold plate B heat sink 116 and a cold plate B insulator 117. The hot plate B has a hot plate B heat sink 118 and a hot plate B insulator 119. All four hot and cold plates may be similar in construction to the plate shown in FIG. 10.

The thermal insulator membrane 115 preferably has a low specific heat, has a low thermal conductivity, is lightweight, and is easily deformed, so that there is a minimal loss of energy during deformation. During operation of the compressor and heat pump, the thermal insulator membrane largely transmits pressure and/or volume from one chamber to the other, while largely insulating against temperature transfer from one chamber to the other. The thermal insulator membrane 115 may be made from a foil sealed mineral wool, although any suitable material may be used.

It is instructive to trace through one full cycle of the compressor and heat pump combination. The cycle described below is merely exemplary, and is not intended to limit invention in any way. Other suitable cycles may be used. Some of the steps described below may be combined, or performed in another order.

Initially, the prongs of heat sinks 116 and 118 of both plates 123 and 124 in chamber B 122 lie within the insulators 117 and 118, so that chamber B 122 is thermally insulated; essentially no heat can flow into or out of chamber B 122.

Chamber A 121 is then set to its "cold" cycle, where the prongs of cold plate A heat sink 111 are exposed through cold plate A insulator 112, and the prongs of hot plate A heat sink 113 lie within hot plate A insulator 114. As a result, chamber A 121 is exposed to the cold plate and is insulated from the hot plate.

The fixed amount of gas inside chamber A 121 is cooled, and therefore contracts. This contraction reduces the pressure inside chamber A 121 to a value less than that inside chamber B 122. As a result, the thermal insulator membrane 115 is deformed into a portion of chamber A 121, as it essentially equalizes the pressure between the two chambers 121 and 122.

In chamber B 122, both hot and cold plates are insulated from the gas in the chamber, so that when the thermal insulator membrane 115 deforms into chamber A 121, the effective volume of chamber B 122 increases. Because the volume of chamber B 122 increases, and no heat can enter or exit chamber B 122, the temperature of the gas in chamber B 122 decreases. Chamber B 122 becomes cooled, with the temperature of the gas in chamber B 122 dropping to that of cold plate B or below that of cold plate B.

Next, the prongs of cold plate B heat sink 116 are exposed through cold plate B insulator 117, while the hot plate B remains insulated. It is in this stage that the compressor/heat pump 110 is shown in FIG. 11. The prongs of cold plate A 111 may then optionally be covered , so that chamber A 121 is thermally insulated from both hot and cold plates 110 and 120.

Because the gas in chamber B 122 is cooler than cold plate B 123, exposure to cold plate B 123 actually warms up the gas in chamber B. In warming up the gas from cold plate B, an increment of heat energy passes from the cold plate B 123 to the gas, making cold plate B even colder.

The prongs of the cold plate B heat sink 116 are then covered, so that chamber B 122 becomes thermally insulated.

If the prongs of the cold plate A heat sink 111 are not already covered, they become covered, and the prongs of hot plate A heat sink 113 become exposed. The gas in chamber A 121 is exposed to the high temperature of hot plate A 120 and becomes heated. The heated gas in chamber A 121 expands, increasing the pressure in chamber A 121, and deforming the thermal insulator membrane 115 into chamber B 122.

Because chamber B 122 is thermally insulated and its volume is decreased, the fixed amount of gas inside chamber B is heated, and is heated to a temperature roughly equal to or greater than that of hot plate B.

The prongs of the hot plate B heat sink 118 are then exposed through the hot plate B insulator 119, while the cold plate B is still insulated from the gas in chamber B 122. It is in this state that compressor/heat pump 120 is shown in FIG. 12.

Because the gas in chamber B 122 is hotter than hot plate B 124, an increment of heat energy flows from the gas into hot plate B 124, making hot plate B 124 hotter.

The prongs of the hot plate B heat sink 118 are then covered, making chamber B thermally insulated from both plates. The prongs of the cold plate A heat sink 111 are then exposed, and the next cycle begins.

The cycle described above is merely exemplary, and is not intended to limit the invention in any way. Operation of the compressor and heat pump may be begun at any point in the cycle, and many steps may be combined or performed in a different order.

It should be noted that the true operating efficiency of the compressor and heat pump varies as a function of when in the cycle the plates become exposed to the gas in their respective chamber. For instance, although the above discussion proposes that the passive cold plate becomes exposed once the expansion of the active chamber is completed, an alternative is to expose the passive cold plate when the temperature in the passive chamber drops to roughly equal to the temperature of the passive cold plate. Temperature sensors may be installed in the various plates and chambers for this purpose. In general, the efficiencies of the heat pump and the compressor may be tuned by adjusting the phase at which the plates are actuated.

Figure 7:
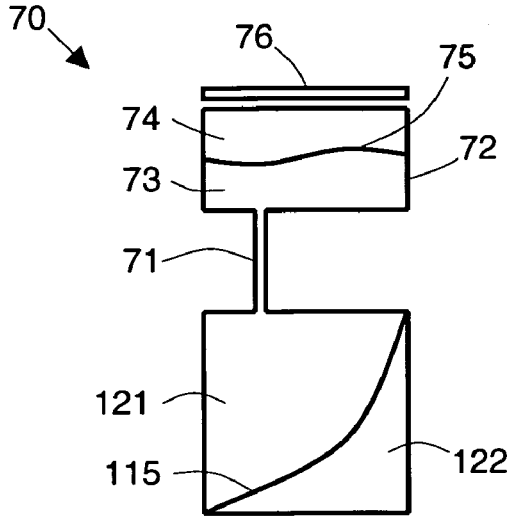
FIG. 7 is a plan drawing of a compressor with a correcting bladder.

The performance of the compressor and heat pump combination may vary, depending on the outdoor temperature. FIG. 7 shows an addition to the compressor and heat pump combination that may help optimize performance over a much longer time scale, say, in terms of days or weeks. In the optimizer or corrective bladder 70, the active chamber 121, also known as the compressor chamber, is connected by a high-resistance tube 71 to an optimizer chamber 72, preferably through one of the edges that does not have a hot or cold plate. The optimizer chamber 72 contains a particular amount of gas 73, preferably of the same type of gas or gases that are in the active chamber 121. The gas 73 is sealed by an interface 75 from a phase change material 74, which can pass from liquid to gas or gas to liquid. The phase change material 74 is thermal contact with the outdoor temperature, which is represented in FIG. 7 as a thermal conductor 76.

As the phase change material 74 is exposed to the outdoor temperature, a varying amount of the phase change material 74 may be in a liquid state, with the rest being a gas. The warmer it gets outside, the more gas 74 there is on the topmost side of the interface 75, and the higher the pressure in optimizer chamber 72. The interface 75 is flexible and/or deformable, and deforms in response to the change in gas 74 pressure. On the opposite side of the interface 75, a varying amount of gas 73 is forced into or out of the active chamber 121.

Element 71 is FIG. 7 is a high-resistance tube, which does not allow the free exchange of pressure like a conventional tube, but instead acts in the manner of a low-pass filter. The high-resistance tube 71 is relatively insensitive to the high-frequency changes in pressure that occur about once per cycle in the active chamber 121, but allows the low-frequency changes that arise from daily or seasonal effects to pass. In this manner, the total amount of gas inside the active chamber 121 may be adjusted, in response to the daily or seasonal changes in outdoor temperature.

It is useful to summarize thus far. The combination compressor and heat pump shown in FIGS. 11 and 12 has an active chamber and a passive chamber, each with its own hot plate and cold plate. The two chambers are joined along an edge by a membrane that largely transmits pressure by varying volume, largely insulates against temperature transfer, and largely blocks passage of gases from one chamber to the other. The gas in the active chamber is alternately cooled and heated by exposure to the active cold and active hot plates. This causes pressure changes in the active chamber that are transmitted to the passive chamber by volume changes due to deformation of the membrane. The pressure changes alternately cool the gas in the passive chamber below the temperature of the passive cold plate, and heat the gas in the passive chamber above the temperature of the passive hot plate. In alternately exposing the cooled gas in the passive chamber to the passive cold plate, and the heated gas in the passive chamber to the passive hot plate, a thermal differential is established and maintained between from the passive cold plate and the passive hot plate.

The utility of such a compressor and heat pump is described below. One potential use is for cooling and/or heating a building. Operation of the compressor and heat pump is extremely quiet, since the only moving parts are the flexible membrane and the plate insulator actuators.

A combined compressor and heat pump can cool a house, using the following illustrative conditions: The active hot plate (e.g., hot plate A 120) is thermally coupled to a flame, as in a furnace, for instance, with an exemplary temperature of about 700 K., or 800° F. The active cold plate (e.g., cold plate A 110) is thermally coupled to the outside of the house, where an exemplary temperature can be about 311 K, or 1000° F. The passive hot plate (e.g., hot plate B 124) is also thermally coupled to the outside of the house, with an exemplary temperature of about 311 K, or 100° F. The passive cold plate (e.g., cold plate B 123) is thermally coupled to the room, or more specifically, the duct in the room, which can have an exemplary temperature of about 289 K, or 60° F.

When used as a cooler, the compressor and heat pump has maximum possible efficiency that approaches that of conventional air conditioners. An advantage over conventional air conditioners is that the heat pump described herein is much more quiet, having very few moving parts. Another advantage is that a variety of fuel sources may be used, such as natural gas or oil, in contrast with conventional air conditioners that run off electricity.

The compressor/heat pump is even more advantageous when used to heat a house. The passive hot plate (e.g., hot plate B 124) is thermally coupled to the room duct, which may have an exemplary temperature of about 350 K, or 170° F. The passive cold plate (e.g., cold plate B 123) is thermally coupled to the outside of the house, which may have an exemplary temperature of about 245 K, or −19° F. The active hot and cold plates are connected in the same manner as when used as a cooler. The active hot plate (e.g., hot plate A 120) is thermally coupled to a flame, with an exemplary temperature of about 700 K, or 800° F. The active cold plate (e.g., cold plate A 110) is thermally coupled to the room duct, which may have an exemplary temperature of about 350 K, or 170° F.

Given these exemplary temperatures, it is straightforward to show that the maximum possible efficiency of such a heating compressor/heat pump can dramatically exceed conventional furnaces.

A common conventional furnace that provides heat for a house typically burns a fuel, such as natural gas or oil. The flame from the burning fuel heats a transmitting medium, such as air for a forced air heating system or water for a radiator system. The heated transmitting medium is then directed to various parts of the house. The maximum possible efficiency from such a furnace may be considered to be essentially 100%, in that for each joule of heat produced by the flame, one joule of heat is provided to the interior of the house. Naturally, a real furnace has some losses due to factors such as turbulence or friction, which reduce the efficiency from the maximum possible value.

In contrast to the conventional furnace, the efficiency of the compressor/heat pump can actually exceed 100%. The following paragraphs describe and carry out this calculation for an extremely cold day, in which common heat pumps are fairly inefficient. This cold day may be considered a worst-case scenario, and the efficiencies for warmer outside temperatures may be substantially greater.

The temperature of the flame, TF, is taken to be 700 K (800° F., or 427° C.). The temperature of the duct, TD, is taken to be 350 K (170° F., or 77° C.). The temperature outside, TO, is taken to be 245 K (−19° F., or −28° C).

We assume that a heat engine placed between the flame and the duct produces work, with a work output of WO. The waste heat from the heat pump, QW, is directed to the duct.

The heat produced by the flame is QF.

The work output is given by WO=QF* (1-TD/TH)=QF* (1-350/700)=QF* 0.5.

The energy, WI, required by the heat pump to bring heat amount of QDpump from the outside at temperature, TO, to the duct at temperature, TD, is given by WI=QDpump* (1-TO/TD)=QDpump* (1-245/350)=QDpump* 0.3

The waste heat is given by QWaste=QF−WO=QF−QF* 0.5=QF* 0.5.

Note that QWaste is equal to QDengine, which is the waste heat from the engine to the duct.

The total amount of heat being delivered to the duct is QDtotal=QDpump+QWaste=WI/0.3+QWaste=(0.5* QF/0.3)+(QF* 0.5)=13/6* QF.

For the exemplary numbers given above, for each joule of heat energy obtained from the flame, over 2.1 joules of heat are supplied to the duct. Compare this to a conventional furnace, in which each joule of heat energy obtained from the flame supplies 1 joule of heat to the duct.

The numerical example above assumed that the outside temperature is extremely cold, as sort of a worst-case scenario. At warmer temperatures, the efficiency of the heat pump increases.

In general, both the compressor and the heat pump benefit from very hot temperatures on the active hot plate. This is commonly a flame provided by burning a fuel, such as natural gas or oil, although other sources of heat may be used. The efficiency of the compressor tends to rise with the temperature difference between hot and cold plates, so efficiency may be optimized by using the highest hot plate temperature that is feasible, where the hot temperatures do not damage the materials inside the device.

There are other applications that may benefit from use of such a heat pump. For instance, a chemical bath that is used for processing a mixture of chemicals for distillation would also benefit from the use of such a heat pump. In general, the heat pump would benefit most processes that require heating and cooling simultaneously, such as the distillation of ethanol from a beer mixture. While the waste heat and pumped heat are used to evaporate ethanol from the bath, the heat is drawn from an area that requires cooling, such as the condenser or chiller.

The active chamber of a compressor apparatus, the passive chamber of a heat pump, and the active and passive chambers of a combined compressor and heat pump may have any desired configuration, including, for example, a rectangular block, a cube, a cylinder, a sphere, and so forth. The deformable member may be configured to match the configuration of the active and/or passive chamber, if desired. Similarly, the hot and cold plates may have any desired shape, including, for example, flat, curved about one axis to form a cylindrical section, curved about two axes to form a spherical or elliptical section, and so forth. Moreover, the hot and cold plates may have any desired thickness ranging from thin to thick, depending on the materials used for the plate and the technique used to heat or cool the plate. Although the particular examples of compressors and heat pumps presented herein are described with reference to one active and/or one passive chamber, which may form an open space bounded by hot and cold plates as well as by the deformable member, or which may form contiguous sectional spaces bounded respectively by the hot and cold plates and by the deformable member, it will be understood that multiple active and/or multiple passive chambers of similar or different design may be used if desired. While the term "fluid" as used herein refers to gases and liquids, it does not necessary exclude the presence of some solid matter dispersed within or otherwise commingled with the solid or liquid, whether intentionally to establish a particular property, or unintentionally as by contamination, or inherently as by a phase change of some of the fluid into a solid phase or by shedding of solid material from structures and surfaces within the chamber.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

I claim:

1. A thermodynamic cycle apparatus, comprising:

a first chamber for housing a first fluid within a variable volume;

a hot plate;

a cold plate;

a thermal insulator for cyclically and alternately coupling the hot plate and the cold plate to the first chamber;

a second chamber for housing a second fluid within a variable volume; and a deformable volume transmitting medium disposed between the first and second chambers for inversely varying the volume of one of the first and second chambers as a function of pressure in the other of the first and second chambers, the deformable volume transmitting medium having low thermal conductivity and being highly impermeable to the first and second fluids.

2. The thermodynamic cycle apparatus of claim 1, wherein:

the deformable volume transmitting medium comprises a first side and a second side distinct and separate from the first side;

the first chamber is at least partially bounded by the first side of the deformable volume transmitting medium; and the second chamber is at least partially bounded by the second side of the deformable volume transmitting medium.

3. The thermodynamic cycle apparatus of claim 1, wherein the hot and cold plates are thermally active for forming a compressor.

4. The thermodynamic cycle apparatus of claim 1, wherein the hot and cold plates are thermally passive for forming a heat pump.

5. The thermodynamic cycle apparatus of claim 1, wherein the deformable volume transmitting medium comprises a flexible membrane.

6. The thermodynamic cycle apparatus of claim 1, wherein the deformable volume transmitting medium comprises a flexible membrane disposed across a fixed volume for separating the fixed volume into the first chamber and the second chamber.

7. The thermodynamic cycle apparatus of claim 1, wherein:

the deformable volume transmitting medium comprises a flexible membrane; and the first chamber comprises:

a first section at least partially bounded by the hot and cold plate; and a second section at least partially bounded by the flexible membrane, the second section being contiguous with the first section.

8. The thermodynamic cycle apparatus of claim 1, wherein the deformable volume transmitting medium comprises a liquid.

9. The thermodynamic cycle apparatus of claim 1, further comprising:

a closed conduit extending between the first and the second chambers;

wherein the deformable volume transmitting medium comprises a non-mixing liquid contained within and filling a portion of the closed conduit, the liquid having a first surface partially bounding the first chamber and a second surface at least partially bounding the second chamber.

10. The thermodynamic cycle apparatus of claim 1, wherein the thermal insulator comprises a block of thermal insulation.

11. The thermodynamic cycle apparatus of claim 1, wherein:

the hot plate comprises a hot plate heat sink having hot plate heat sink prongs;

the cold plate comprises a cold plate heat sink having cold plate heat sink prongs; and the thermal insulator comprises a hot section disposed between the hot plate heat sink and the first chamber and controllably surrounding the hot plate heat sink prongs, and a cold section disposed between the cold plate heat sink and the first chamber and controllably surrounding the cold plate heat sink prongs.

12. A compressor, comprising:

a first variable volume chamber comprising a first fluid;

a second variable volume chamber comprising a second fluid;

means for exposing the first fluid to a hot source while insulating the first fluid from a cold source to increase pressure of the first fluid and volume of the first chamber;

means for deforming a portion of the second chamber to transfer the volume increase of the first chamber as a volume decrease in the second chamber and to substantially equalize pressures of the first and second fluids in the first and second chambers at a higher pressure;

means for exposing the first fluid to a cold source while insulating the first fluid from a hot source to decrease pressure of the first fluid and volume of the first chamber;

means for deforming the second chamber portion to transfer the volume decrease of the first chamber as a volume increase in the second chamber and to substantially equalize pressures of the first and second fluids in the first and second chambers at a lower pressure; and means for thermally insulating the first chamber from the second chamber.

13. A method of compressing fluid, comprising:

exposing a first fluid within a first chamber to a hot source while insulating the first fluid from a cold source to increase pressure of the first fluid and volume of the first chamber;

deforming a portion of a second chamber to transfer the volume increase of the first chamber as a volume decrease in the second chamber and to substantially equalize pressures of the first fluid in the first chamber and a second fluid in the second chamber at a higher pressure;

exposing the first fluid to the cold source while insulating the first fluid from the hot source to decrease pressure of the first fluid and volume of the first chamber;

deforming the second chamber portion to transfer the volume decrease of the first chamber as a volume increase in the second chamber and to substantially equalize pressures of the first and second fluids in the first and second chambers at a lower pressure; and thermally insulating the first chamber from the second chamber during all of the exposing and deforming steps.

14. The method of claim 13, further comprising:

adjusting the pressure of the first fluid in the first chamber with a bladder, the bladder being coupled to the first chamber by a frequency-sensitive coupler that allows coupling at low frequencies and blocks coupling at high frequencies.

15. A compressor, comprising:

a first chamber having a first fluid therein;

a hot source having variable thermal conductivity with the first chamber;

a cold source having variable thermal conductivity with the first chamber;

a second chamber having a second fluid therein; and a deformable transfer medium disposed between the first and second chambers and in contact with the first and second fluids, the deformable transfer medium having low thermal conductivity and being highly impermeable to the first and second fluids.

16. The compressor of claim 15, wherein during a heating phase, the hot source has high thermal conductivity with the first chamber and the cold source has low thermal conductivity with the first chamber to expand the first chamber; and during a cooling phase, the cold source has high thermal conductivity with the first chamber and the hot source has low thermal conductivity with the first chamber to contract the first chamber.

17. The compressor of claim 16, wherein the second chamber contracts with the expansion of the first chamber, and the second chamber expands with the contraction of the first chamber.

18. The compressor of claim 15, wherein the first chamber is sealed.

19. A heat pump, comprising:

a first chamber having a first fluid therein;

a heat sink having variable thermal conductivity with the first chamber;

a cold sink having variable thermal conductivity with the first chamber;

a second chamber having a second fluid therein; and a deformable transfer medium disposed between the first and second chambers and in contact with the first and second fluids, the deformable transfer medium having low thermal conductivity and being highly impermeable to the first and second fluids.

20. The heat pump of claim 19, wherein during a heating phase, the cold sink has low thermal conductivity with the first chamber and the heat sink has high thermal conductivity with the first chamber to transfer heat from the first fluid to the heat sink, and during a cooling phase, the heat sink has low thermal conductivity with the first chamber and the cold source has high thermal conductivity with the first chamber to transfer heat from the cold sink to the first fluid.

21. The heat pump of claim 20, wherein the second chamber contracts with the expansion of the first chamber, and the second chamber expands with the contraction of the first chamber.

22. The heat pump of claim 19, wherein the first chamber is sealed.

23. A heat pump, comprising:

a first variable volume chamber comprising a first fluid;

a second variable volume chamber comprising a second fluid;

means for exposing the first fluid to a heat sink while insulating the first fluid from a cold sink;

means for increasing pressure of the second fluid to increase volume of the second chamber;

means for deforming a portion of the first chamber to transfer the volume increase of the second chamber as a volume decrease in the first chamber and to substantially equalize pressures of the first fluid in the first chamber and a second fluid in the second chamber at a higher pressure;

means for exposing the first fluid to the cold sink while insulating the first fluid from the heat sink;

means for decreasing pressure of the second fluid in the second chamber to decrease volume of the second chamber;

means for deforming the first chamber portion to transfer the volume decrease of the second chamber as a volume increase in the first chamber and to substantially equalize pressures of the first and second fluids in the first and second chambers at a lower pressure; and means for thermally insulating the first chamber from the second chamber.

24. A method of pumping heat, comprising:

exposing a first fluid within a first variable volume chamber to a heat sink while insulating the first fluid from a cold sink;

increasing pressure of a second fluid in a second variable volume chamber to increase volume of the second chamber;

deforming a portion of the first chamber to transfer the volume increase of the second chamber as a volume decrease in the first chamber and to substantially equalize pressures of the first fluid in the first chamber and a second fluid in the second chamber at a higher pressure;

exposing the first fluid to the cold sink while insulating the first fluid from the heat sink;

decreasing pressure of the second fluid in the second chamber to decrease volume of the second chamber;

deforming the first chamber portion to transfer the volume decrease of the second chamber as a volume increase in the first chamber and to substantially equalize pressures of the first and second fluids in the first and second chambers at a lower pressure; and thermally insulating the first chamber from the second chamber during all of the exposing, decreasing and deforming steps.

25. The method of claim 24, further comprising:

adjusting the pressure of the first fluid in the first chamber with a bladder, the bladder being coupled to the first chamber by a frequency-sensitive coupler that allows coupling at low frequencies and blocks coupling at high frequencies.

26. A compressor and heat pump combination, comprising:

a compressor chamber having a compressor fluid therein;

a compressor hot plate;

a compressor cold plate;

a compressor thermal insulator for cyclically and alternately coupling the compressor hot plate and the compressor cold plate to the compressor chamber;

a heat pump chamber having a heat pump fluid therein;

a heat pump hot plate;

a heat pump cold plate;

a heat pump thermal insulator for cyclically and alternately coupling the heat pump hot plate and the heat pump cold plate to the heat pump chamber; and a deformable volume transmitting medium for inversely varying volumes of the compressor chamber and the heat pump chamber, the deformable volume transmitting medium having low thermal conductivity and being highly impermeable to the compressor fluid and the heat pump fluid, the compressor chamber being at least partially bounded by a first side of the deformable volume transmitting medium, and the heat pump chamber being at least partially bounded by a second side of the deformable volume transmitting medium.

27. The compressor and heat pump combination of claim 26, wherein the compressor chamber and the heat pump chamber are both sealed.

28. A compressor and heat pump, comprising:

a compressor chamber for housing a compressor fluid;

a compressor hot element;

a compressor cold element;

means for cyclically and alternately coupling the compressor hot element and the compressor cold element to the compressor chamber;

a heat pump chamber for housing a heat pump fluid;

a heat pump hot element;

a heat pump cold element;

means for cyclically and alternately coupling the heat pump hot element and the heat pump cold element to the heat pump chamber; and means for transferring a volume between the compressor chamber and the heat pump chamber, the volume transfer means having low thermal conductivity and being highly impermeable to the compressor fluid and the heat pump fluid, the compressor chamber being at least partially bounded by a first side of the volume transfer means, and the heat pump chamber being at least partially bounded by a second side of the volume transfer means.

* * * * *